US009342017B2

(12) United States Patent
Koseki et al.

(10) Patent No.: US 9,342,017 B2
(45) Date of Patent: May 17, 2016

(54) POWER SUPPLY APPARATUS FOR SAFETY LOAD SHUTDOWN AND IMAGE FORMING APPARATUS INCLUDING THE SAME

(71) Applicant: CANON KABUSHIKI KAISHA, Tokyo (JP)

(72) Inventors: Manabu Koseki, Sakuragawa (JP); Tetsuya Nozaki, Kashiwa (JP); Eijiro Atarashi, Tokyo (JP); Yoritsugu Maeda, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 106 days.

(21) Appl. No.: 13/891,658

(22) Filed: May 10, 2013

(65) Prior Publication Data

US 2013/0322898 A1 Dec. 5, 2013

(30) Foreign Application Priority Data

May 31, 2012 (JP) ..... 2012-125144

(51) Int. Cl.
*G03G 15/36* (2006.01)
*G03G 15/00* (2006.01)

(52) U.S. Cl.
CPC ..... *G03G 15/5004* (2013.01); *G03G 15/80* (2013.01); *Y10T 307/461* (2015.04)

(58) Field of Classification Search
CPC ..... G03G 15/5004; G03G 15/80
USPC ..... 399/37, 88
See application file for complete search history.

(56) References Cited

U.S. PATENT DOCUMENTS 3,852,733 A * 12/1974 Sakurai ..... 340/458
8,203,382 B2 6/2012 Maeda
2012/0091965 A1* 4/2012 Seo et al. ..... 320/128

FOREIGN PATENT DOCUMENTS

JP 2011-22775 A 2/2011

OTHER PUBLICATIONS

Nozaki. Machine Translation of JP2011022775. Published Feb. 2011. Translated Dec. 2014.*
U.S. Appl. No. 13/766,241, filed Feb. 13, 2013 Applicant: Tetsuya Nozaki.

* cited by examiner

*Primary Examiner* — Ryan Walsh
*Assistant Examiner* — Philip Marcus T Fadul
(74) *Attorney, Agent, or Firm* — Fitzpatrick, Cella, Harper & Scinto

(57) ABSTRACT

When a detection signal indicates that a switch has switched off, a first relay cuts off the supply of alternating current from a commercial alternating-current source to a third DC power source and terminates a first load such as a motor and a high-voltage power source. When the detection signal indicates that the switch has switched off, a control circuit executes shutdown processing for safely terminating an operation of a second load such as a hard disk drive. When the shutdown processing is complete, the control circuit outputs a signal for terminating an operation of a second DC power source. When the shutdown signal is input, a second relay terminates the operation of the second load by cutting off the supply of the alternating current from the commercial alternating-current source to a second DC power source.

22 Claims, 5 Drawing Sheets

POWER SUPPLY APPARATUS FOR SAFETY LOAD SHUTDOWN AND IMAGE FORMING APPARATUS INCLUDING THE SAME

BACKGROUND OF THE INVENTION

1. Field of the Invention

The present invention relates to a power supply apparatus and an image forming apparatus including the same.

2. Description of the Related Art

In recent years, because the size of image data and program files has increased, image forming apparatuses have come equipped with a hard disk drive (hereinafter referred to as HDD) capable of storing that information. HDDs have a high likelihood of malfunction compared with semiconductor memory and other memory apparatuses. For instance, if a user switches off the main power supply to an image forming apparatus while the head of the HDD is accessing data, the head cannot withdraw to a safety zone and HDD failure or loss of data can occur. Consequently, some sort of method is needed to protect the HDD when the main power supply is turned off. At the same time, image forming apparatuses have various loads (e.g. motor, heater, high-voltage power supply, and the like). When a user notices an abnormality in a load and switches off the main power supply, the power supply to these loads must be cut off immediately.

Japanese Patent Laid-Open No. 2011-22775 describes an invention in which a relay is connected in parallel to a main power switch that switches the supply of electrical power from an alternating-current source on and off, and even if the main power switch is turned off, the electrical power from the alternating-current source continues to be supplied for a period of time via the relay. Moreover, Japanese Patent Laid-Open No. 2011-22775 discloses that the electrical power supply to loads such as the motor can be cut off instantaneously with a relay provided so as to operate in conjunction with a status signal that indicates whether the main power switch is on or off.

According to Japanese Patent Laid-Open No. 2011-22775, although the supply of electrical power to loads such as the motor is cut off immediately when the main power switch is turned off, there is an advantage in that electric power can continue to be supplied to the HDD. However, a new problem arises in the invention described in Japanese Patent Laid-Open No. 2011-22775 in that a large number of switches and relays are needed.

SUMMARY OF THE INVENTION

In view of this, the present invention provides a power supply apparatus that both protects loads that require shutdown, such as an HDD, and instantaneously cuts off electrical power to loads that do not require shutdown, with a reduced number of switches and relays.

An embodiment of the present invention provides a power supply apparatus comprising the following elements. A first conversion unit is configured to convert alternating current supplied by an alternating-current source into direct current. A second conversion unit is configured to convert alternating current supplied by the alternating-current source into direct current to be supplied to a second load. A third conversion unit is configured to convert alternating current supplied by the alternating-current source into direct current to be supplied to a first load. A power switch is configured to be operated manually in order to perform power source shutdown, and generate an indication signal that indicates shutdown. A first cutoff unit is configured to terminate an operation of the first load by cutting off a supply of alternating current from the alternating-current source to the third conversion unit when the indication signal is input. A control unit is configured to run upon being supplied with a direct current voltage output by the first conversion unit, execute shutdown processing for safely terminating an operation of the second load when the indication signal is input, and output a termination signal for terminating the operation of the second conversion unit when shutdown processing with respect to the second load is complete. A second cutoff unit is configured to terminate the second load by cutting off a supply of alternating current from the alternating-current source to the second conversion unit when the termination signal is input. The first cutoff unit is further configured to cut off the supply of alternating current from the alternating-current source to the third conversion unit when one of the indication signal and the termination signal is input.

Further features of the present invention will become apparent from the following description of exemplary embodiments with reference to the attached drawings.

DESCRIPTION OF THE EMBODIMENTS

Embodiment 1

Figure 1:
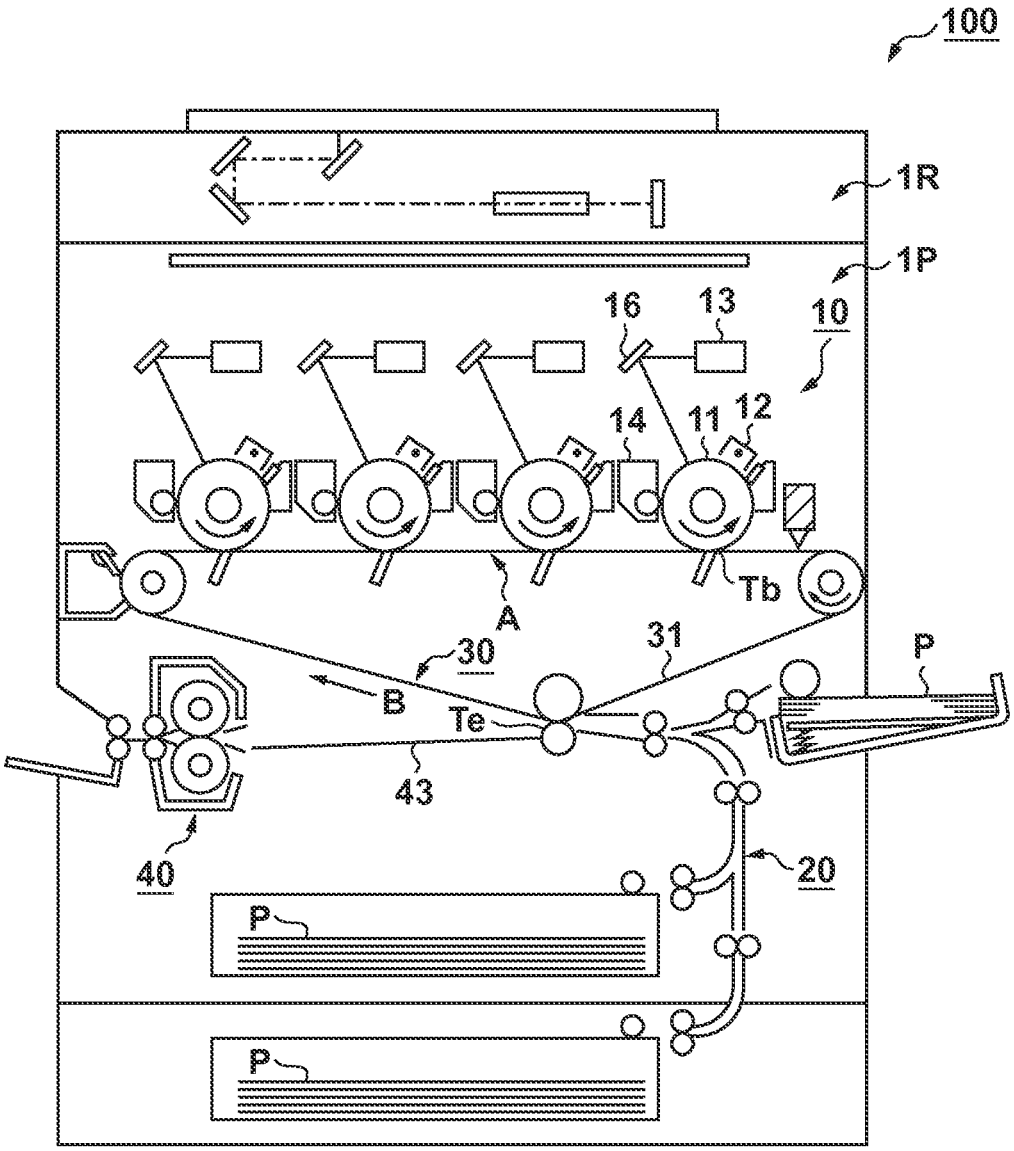
FIG. 1 is a diagram showing an image forming apparatus according to Embodiment 1 and 2.

The following describes an example of an image forming apparatus that runs with power supplied by a power supply apparatus of the present embodiment with reference to FIG. 1. An image forming apparatus 100 may be a printer or multifunction printer, or a facsimile apparatus but here, it is considered to be an electrographic color copy machine. Note that the present invention is also applicable to a monochrome image forming apparatus that forms monochrome images. Additionally, the present invention is applicable to any electronic devices equipped with a load that requires shutdown and a load that does not require shutdown.

The image forming apparatus 100 includes an image reading unit 1R, which reads images from originals, and an image output unit 1P, which forms images on transfer materials. The image output unit 1P has four parts: an image forming unit 10, a paper feeding unit 20, an intermediate transfer unit 30, and a fixing unit 40.

The image forming unit 10 includes drum-shaped electrophotographic photoreceptors as image carriers that carry toner images, namely, photoreceptor drums 11. The photoreceptor drums 11 are driven by a motor such as a DC brushless motor or the like. A primary charger 12 uniformly charges the surface of a photoreceptor drum 11 by applying a charging high voltage (e.g., 1 to 2 [kV]) to the photoreceptor drum 11. An exposure unit 13 irradiates the photoreceptor drum 11 with a laser beam that is modulated according to an imaging signal output by the image reading unit 1R. As a result, an electrostatic latent image is formed. A developing unit 14 develops the electrostatic latent image into a toner image using a developing material (toner). The developing unit 14 promotes toner image formation by applying a developing high voltage (e.g., 2 [kV]) to the developing nip area. In an image transfer area Ta, the toner image is transferred to a belt-shaped intermediate transfer member, namely, an intermediate transfer belt 31, which functions as an image carrier that configures the intermediate transfer unit 30. In the primary transfer zone Ta, a primary transfer high voltage (e.g., 1 to 2 [kV]) is applied.

The paper feeding unit 20 feeds transcription materials P, which are stored in a cassette or manual tray, to a transport path and transports them along the transport path. In a secondary image transfer zone Te, the toner image is transferred from the intermediate transfer belt 31 to a transcription material P. In the secondary transfer zone Te, a secondary transfer high voltage (e.g., 3 to 5 [kV]) is applied. The fixing unit 40 fixes the toner image to the transcription material P by applying heat and pressure to the unfixed toner image on the transcription materials P. The transfer material P is sometimes called a sheet, recording material, or recording medium.

Figure 2:
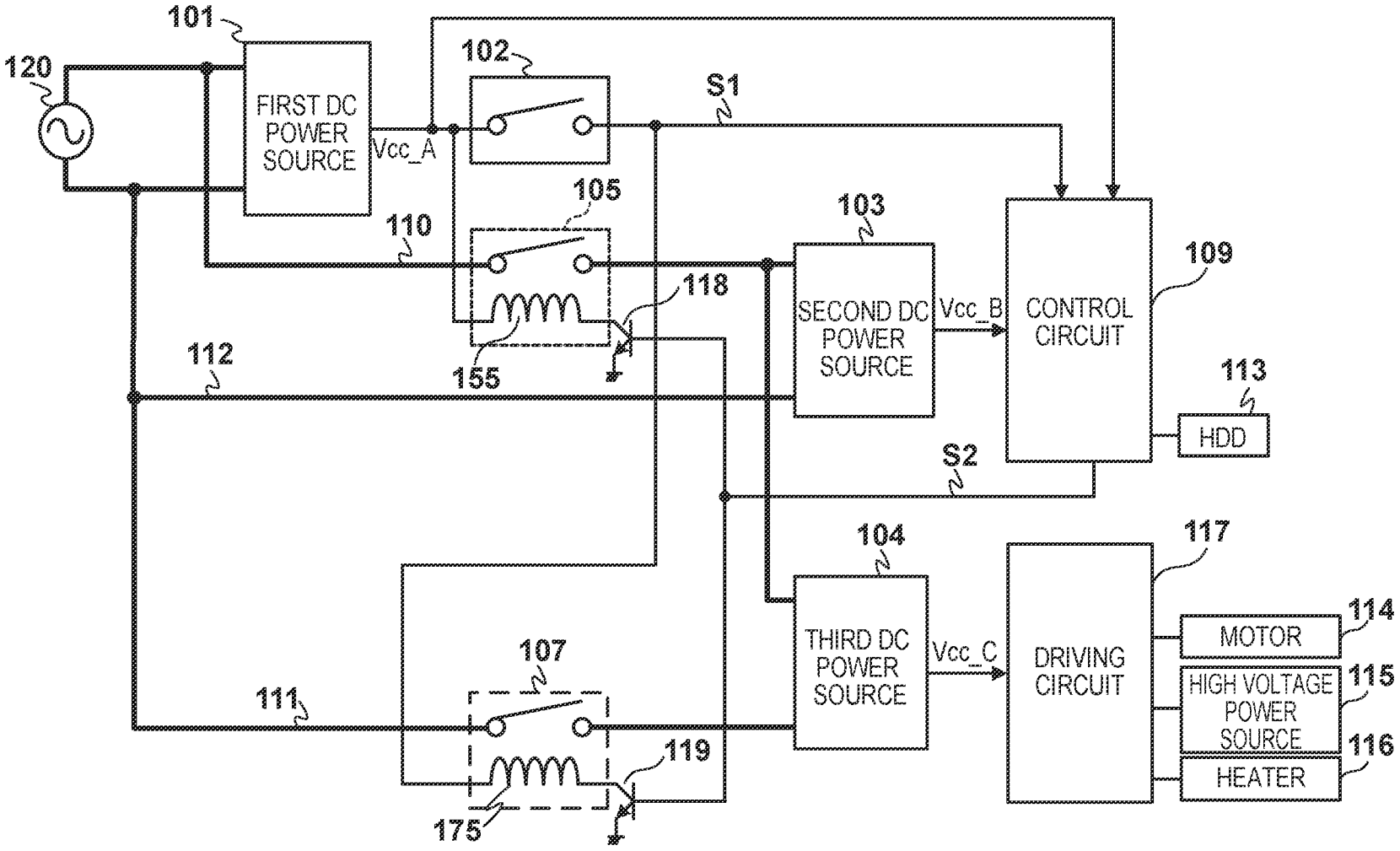
FIG. 2 is a diagram showing a power supply apparatus according to Embodiment 1.

A power supply apparatus 200 of the present embodiment, indicated in FIG. 2, will be described below. The image forming unit 10 forms images due to the image forming apparatus supplying power to the image forming unit 10 of the image forming apparatus 100 from power supply apparatus 200, and the like. A first DC power source 101 is a power supply circuit that generates a direct current voltage from an alternating current voltage supplied by a commercial alternating-current source 120. In other words, the first DC power source 101 can function as a first conversion unit that converts alternating current supplied by the alternating-current source into direct current. The first DC power source 101 receives a supply of electrical power from a commercial alternating-current source 120 and outputs a voltage Vcc_A, regardless of whether a main power switch 102 is on or off. The voltage Vcc_A is supplied to a second relay 105. The first DC power source 101 supplies the direct current voltage Vcc_A (e.g., DC3.3 [V]) to a control circuit 109 that controls the operation of the image forming apparatus 100. The main power switch 102 is one example of a power switch that is operated manually by the operator.

The control circuit 109 includes a hard disk drive (HDD 113) for storing a control program, image data, and the like. Additionally, the voltage Vcc_A is applied to one terminal of the main power switch 102. The other terminal of the main power switch 102 is connected to the signal input terminal of the control circuit 109, and one terminal of a magnet coil 175 built into a first relay 107. Note that the relay is a switch element that switches a gap between two electrodes (a contact) to closed/open in accordance with the magnet coil being on or off. A main power switch detection signal S1, which is generated by the main power switch 102, is a status signal that indicates whether the main power switch 102 is in an on state or in an off state. The main power switch detection signal S1 is input to the signal input terminal of the control circuit 109 and one terminal of the built-in magnet coil 175 of the first relay 107. A second relay driving transistor 119 is connected to the other terminal of the built-in magnet coil 175 of the first relay 107.

A second DC power source 103 can function as a second conversion unit that converts alternating current supplied by the alternating-current source into direct current to be supplied to the second load. Alternating current is supplied from the commercial alternating-current source 120 to the second DC power source 103 via a first AC supply line 110 connected by a second relay 105, and a third AC supply line 112. Vcc_A is applied to one terminal of a magnet coil 155 included in the second relay 105, and a first relay driving transistor 118 is connected to the other terminal. The first relay driving transistor 118 and the second relay driving transistor 119 function as the second switching element and the first switching element respectively. The second DC power source 103 generates a direct current voltage Vcc_B (e.g., DC5 [V]) for driving the HDD 113.

When the voltage Vcc_A is supplied, the control circuit 109 starts operating and outputs a high level shutdown signal S2 for activating the second DC power source 103. The shutdown signal S2 is supplied to the driving terminal of the first relay driving transistor 118 and the driving terminal of the second relay driving transistor 119. When the high level shutdown signal S2 is output, the first relay driving transistor 118 and the second relay driving transistor 119 run so that the second relay 105 and the first relay 107 switch on respectively. On the other hand, when the main power switch detection signal S1 falls to the low level, the control circuit 109 switches the shutdown signal S2 to the low level. The main power switch detection signal S1 switching from the high level to the low level corresponds to an indication signal for signaling that the power will be shut down. When the shutdown signal S2 falls to the low level, the first relay driving transistor 118 and the second relay driving transistor 119 run so that the second relay 105 and the first relay 107 switch off respectively. Note that in the present embodiment, the first relay 107 is switched off by the main power switch detection signal S1 falling to the low level before the shutdown signal S2 falls to the low level.

A third DC power source 104 can function as a third conversion unit that converts alternating current supplied by the alternating-current source into direct current to be supplied to the first load. The third DC power source 104 generates a voltage Vcc_C (e.g., DC24 [V]) for driving loads such as a motor 114 that drives driven units of the photoreceptor drum 11, a high voltage power source 115 that supplies a high voltage power source to the primary charger 12 and the like, and a heater in the fixing unit 40. The third DC power source 104 is connected to the first AC supply line 110 via the second relay 105, and to the second AC supply line 111 via the first relay 107. In this way, the second relay 105 and the first AC supply line 110 are shared by the second DC power source 103 and the third DC power source 104. When the main power switch detection signal S1 is supplied, the first relay 107 switches on, and an alternating current from the commercial alternating-current source 120 is supplied to the third DC power source 104.

Figure 3A:
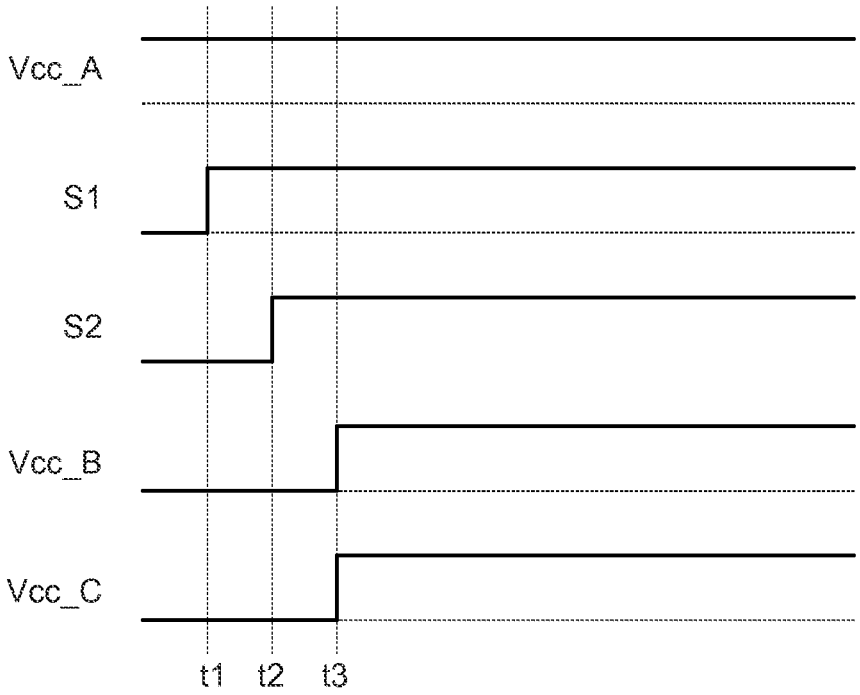
FIGS. 3A and 3B are diagrams showing the timing of signals and voltages according to Embodiment 1.

The operation of the power supply apparatus 200 when the main power switch 102 is switched on will be described below with use of FIG. 3A. Note that the waveforms and timings of the signals and voltages are exaggerated in some portions and simplified in others for the sake of convenience in the description.

The first DC power source 101 continuously outputs the voltage Vcc_A since electrical power is continuously supplied by the commercial alternating-current source 120. When the main power switch 102 is switched on at a time instant t1, the main power switch detection signal S1 is supplied at the high level to the control circuit 109 and the first relay 107. Thereafter, at a time instant t2, the control circuit 109 outputs the shutdown signal S2 at the high level. This causes the first relay driving transistor 118 and the second relay driving transistor 119 to run, and the second relay 105 and the first relay 107 to switch on. At a time instant t3, the second DC power source 103 receives an alternating current supplied by the first AC supply line 110 and the third AC supply line 112 and generates the voltage Vcc_B. When the voltage Vcc_B is supplied to the control circuit 109, it begins to control the HDD 113. In other words, the HDD 113 is driven by the voltage Vcc_B.

At the time instant t3, an alternating current is also supplied to the third DC power source 104 by the second AC supply line 111 via the first relay 107. This causes the third DC power source 104 to output the voltage Vcc_C. The third DC power source 104 supplies the voltage Vcc_C to a driving circuit 117. The driving circuit 117, having been supplied with the voltage Vcc_C, begins to control the motor 114, the high-voltage power source 115, the heater 116, and the like.

In this way, after the main power switch 102 is switched on, the second DC power source 103 and the third DC power source 104 begin to output the respective voltages Vcc_B and Vcc_C, allowing the image forming apparatus 100 to begin image forming operations.

Figure 3B:
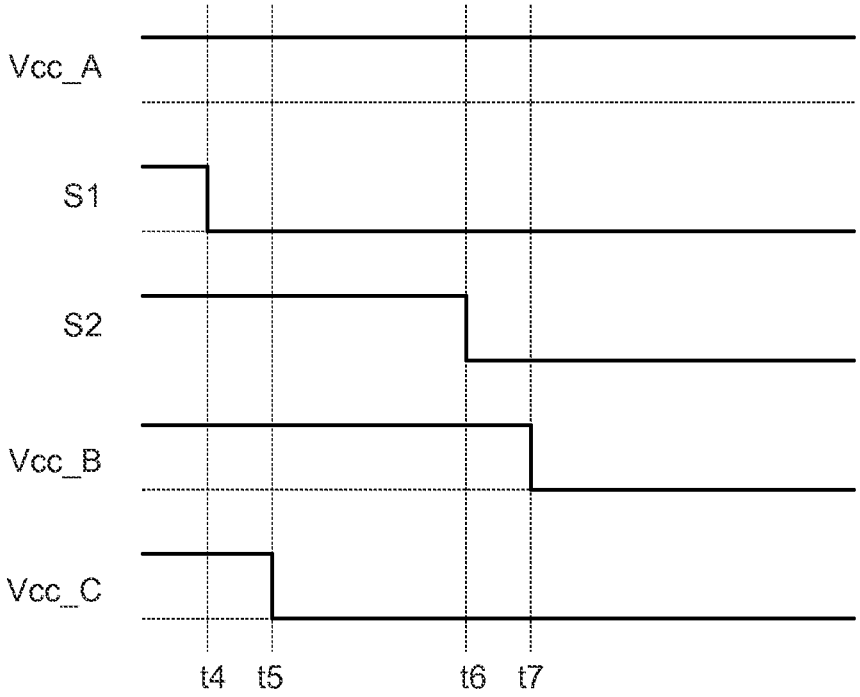

The operation of the power supply apparatus 200 when the main power switch is switched off will be described below with use of FIG. 3B. Note that the waveforms and timings of the signals and voltages are exaggerated in some portions and simplified in others for the sake of convenience in the description.

When the main power switch 102 is switched off at a time instant t4, the main power switch detection signal S1 falls to the low level since the supply of the voltage Vcc_A is cut off. When the main power switch detection signal S1 falls to the low level, the first relay 107 switches off. Consequently, the supply of the alternating current from the second AC supply line 111 is cut off, and at a time instant t5, the output from the third DC power source 104 switches off. In this way, the load driving voltage Vcc_C becomes zero, in tandem with the switching off of the main power switch 102. As stated before, the voltage Vcc_C drives loads such as the motor 114 that drives each driving unit of the photoreceptor drum 11 of the image forming apparatus 100, the high-voltage power source 115 that supplies a high-voltage power source to the primary charger 12 and the like, and the heater in the fixing unit 40 and the like. For this reason, when the operator switches off the main power switch 102, the supply of electric power to loads with high electric power consumption is instantaneously cut off. Note that at this point in time, of the lines for supplying alternating current to the third DC power source 104, only the second AC supply line 111 is cut off, and the first AC supply line 110 is not cut off.

At the time instant t5, the voltage Vcc_A continues to be supplied to the second relay 105 from the first DC power source 101, and the control circuit 109 continues to output the high level shutdown signal S2. For this reason, at the time instant t5, electric power is supplied to the second DC power source 103 via the first AC supply line 110. As a result, the voltage Vcc_B is output even if the main power switch 102 is turned off.

The control circuit 109 maintains the shutdown signal S2 at the high level until a shutdown operation begins. When the shutdown operation begins, the control circuit 109 changes the shutdown signal S2 to the low level. The shutdown operation is processing that is necessary for the control circuit 109 to switch off the image forming apparatus 100 (e.g., processing for saving data to the HDD 113). Accordingly, it is necessary for the control circuit 109 to supply electric power to the HDD 113 until data saving processing is complete. When the shutdown operation is complete at a time interval t6, the control circuit 109 switches the shutdown signal S2 to the low level. When the shutdown signal S2 switches to the low level, the second relay 105 is switched off by the first relay driving transistor 118. Thus, the first AC supply line 110 is cut off. At this time, the third AC supply line 112 is still in an energized state. At a time instant t7, the second DC power source 103 terminates the output of the voltage Vcc_B, and the supply of the voltage Vcc_B to the control circuit 109 is terminated. Additionally, with this operation, the third DC power source 104 is cut off from both the first AC supply line 110 and the second AC supply line 111.

In this way, according to the present embodiment, when the main power switch detection signal S1 indicates that the main power switch 102 has been switched off, the first relay 107 cuts off the alternating current supply from the commercial alternating-current source 120 to the third DC power source 104 and functions as a first cutoff unit that terminates the motor 114, high voltage power source 115, and the like, which are the first loads. Additionally, when the main power switch detection signal S1 indicates that the main power switch 102 has been switched off, the control circuit 109 executes shutdown processing for causing the HDD 113, which is the second load, to safely terminate, and functions as a control unit that puts out an operation signal (termination signal) for terminating the second DC power source 103 when the processing for shutting down the HDD 113 is complete. Additionally, when the operation signal for terminating the second DC power source 103 is input, the second relay 105 cuts off the supply of alternating current from the commercial alternating current source 120 to the second DC power source 103 and functions as a second cutoff unit that terminates the HDD 113. Accordingly, when the main power switch 102 is switched off, the supply of electric power to loads that do not require saving processing can be instantaneously terminated, while the supply of electric power to loads that require saving processing can be temporarily maintained. At the same time, in the present embodiment, the first cutoff unit and the second cutoff unit can be implemented with relays. In the prior art, a total of four switches and relays are necessary, but in the present embodiment, only a total of 3 switches and relays is necessary. Consequently, the number of switches and relays can be reduced. In this way, in the present embodiment, a circuit structure is provided that both protects loads that require shutdown, such as an HDD, and instantaneously cuts off electrical power to loads that do not require shutdown, with a reduced number of switches and relays.

The first relay 107 functions as a first relay equipped with a magnet coil, which is the magnet coil 175. The second relay 105 functions as a second relay equipped with a second magnet coil, which is the magnet coil 155. The main power switch detection signal S1 is applied to the magnet coil 175 of the first relay 107. When the main power switch detection signal S1 indicates that the main power switch 102 has been switched off, the magnet coil 175 switches off, and the relay contact becomes open. Consequently, the first relay 107 operates so as to cut off the supply of the alternating current from the commercial alternating-current source 120 to the third DC power source 104. The direct current voltage Vcc_A is applied to one end of the magnet coil 155 of the second relay 105. Connected to the other end of the magnet coil 155 is the switching element that switches off when the low level shutdown signal S2 is input. In other words, when the low level shutdown signal S2 is input, the magnet coil 155 switches off and the relay contact becomes open. Accordingly, the second relay 105 cuts off the supply of alternating current from the commercial alternating-current source 120 to the second DC power source 103. This signal connection pattern in particular contributes to the reduction of the number of switches and relays.

Additionally, one of the two lines that supply alternating current to the second DC power source 103 and one of the two lines that supply alternating current to the third DC power source 104 are both connected to the second relay 105. Consequently, if the second relay 105 switches off, one of the lines to the second DC power source 103 and one of the lines to the third DC power source 104 can be cut off from the commercial alternating-current source 120 at the same time. Note that it is ultimately possible for both AC lines to the third DC power source 104 to be cut off. This is because the first relay 107 is connected to one of the lines, and the second relay 105 is connected to the other.

Embodiment 2

Figure 4:
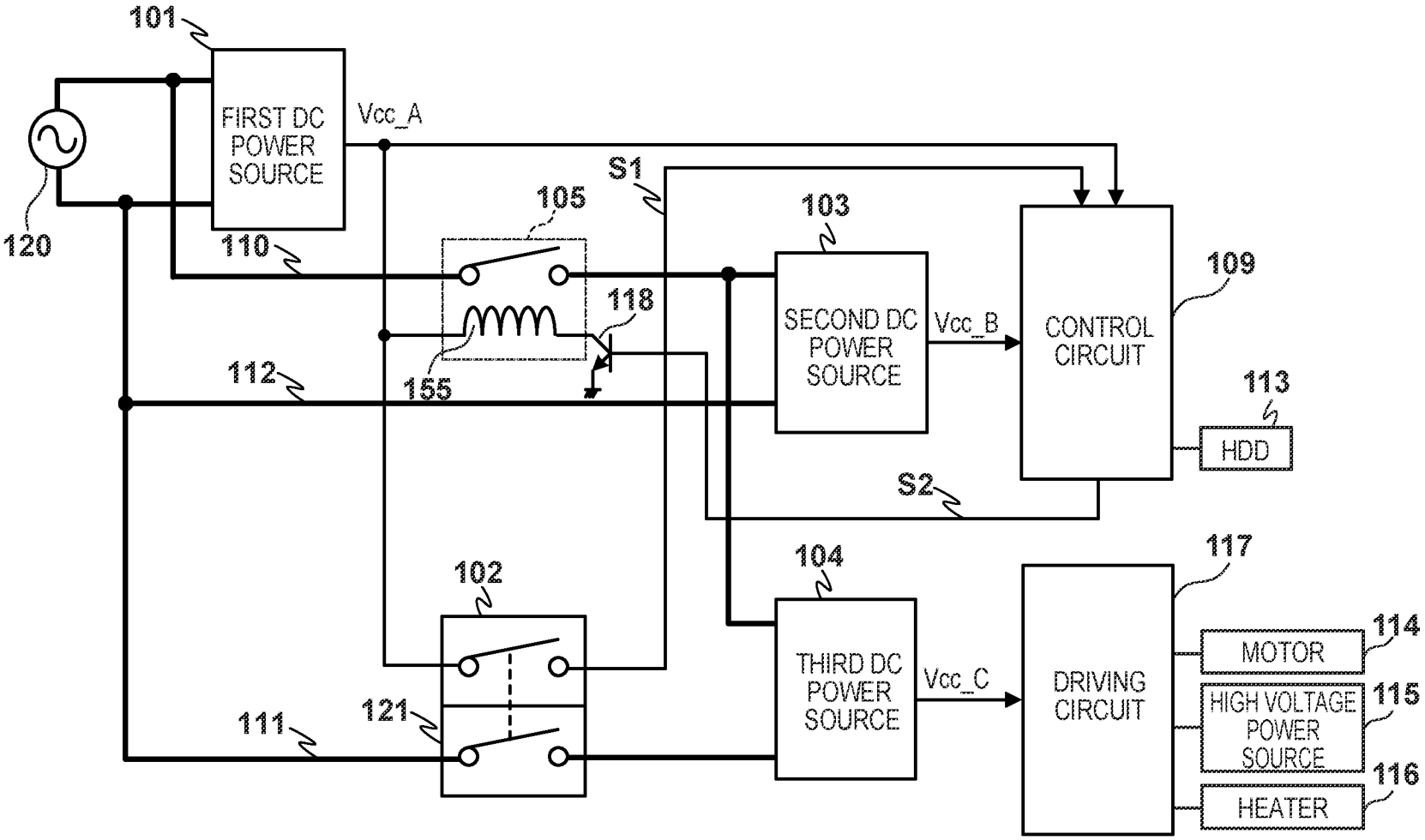
FIG. 4 is a diagram showing a power supply apparatus according to Embodiment 2.

A power supply apparatus 400 of the present embodiment will be described below with use of FIG. 4. The same reference numerals will be given to configurations that are similar to those in Embodiment 1 in order to simplify the description. The power supply apparatus 400 is also able to be installed in an image forming apparatus. In Embodiment 2, the first relay 107 has been replaced with a power supply switch 121 that is able to carry and cut off alternating current from the commercial alternating-current source 120. The power supply switch 121 is integrated so as to mechanically interlock with the main power switch 102 that generates the main power switch detection signal S1. Note that it is possible to have a configuration in which the power supply switch 121 is operated by the operator, and the main power switch 102 is interlocked with the power supply switch 121.

The third DC power source 104 is connected to the first AC supply line 110 via the second relay 105, and to the second AC supply line 111 via the power supply switch 121. The third DC power source 104 and the second DC power source 103 share the first AC supply line 110 via the second relay 105, as was described in Embodiment 1. When the power supply switch 121 is on, alternating current is supplied to the third DC power source 104 through the AC supply line 111.

Figure 5A:
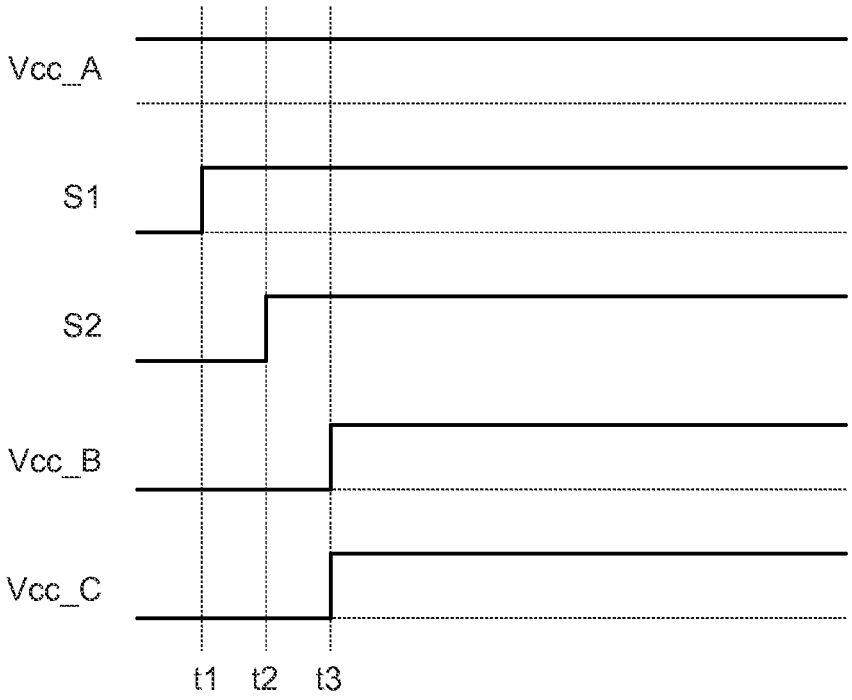
FIGS. 5A and 5B are diagrams showing the timing of signals and voltages according to Embodiment 2.

The operation when the main power switch 102 is switched on will be described below with use of FIG. 5A. Note that the waveforms and timings of the signals and voltages are exaggerated in some portions and simplified in others for the sake of convenience in the description.

When the main power switch 102 is switched on at the time instant t1, the power supply switch 121 is switched on, and therefore, alternating current is supplied from the second AC supply line 111 to the third DC power source 104. Moreover, the high level main power switch detection signal S1 is supplied to the control circuit 109 due to the main power switch 102 being switched on.

At the time instant t2, the control circuit 109 outputs a shutdown signal S2 at the high level. Due to the shutdown signal S2 switching from the low level to the high level, the first relay driving transistor 118 switches on and electric current flows to the magnet coil 155, thus closing the contact. In other words, the second relay 105 switches on. Accordingly, alternating current is supplied to the second DC power source 103 via the first AC supply line 110.

At the time instant t3, the second DC power source 103 begins to supply the voltage Vcc_B to the control circuit 109. When the voltage Vcc_B is supplied, the control circuit 109 begins to control the HDD 113. Alternating current is supplied to the third DC power source 104 due to the second relay 105 having switched on. As a result, at the time instant t3, the third DC power source 104 begins the supply of the voltage Vcc_C to the driving circuit 117. The driving circuit 117, supplied with the voltage Vcc_C, begins to control the motor 114, the high-voltage power source 115, the heater 116, and the like.

When the main power switch 102 is switched on by the operations stated above, the second DC power source 103 and the third DC power source 104 begin to output the voltages Vcc_B and Vcc_C respectively. Accordingly, the image forming apparatus 100 can begin image forming operations.

Figure 5B:
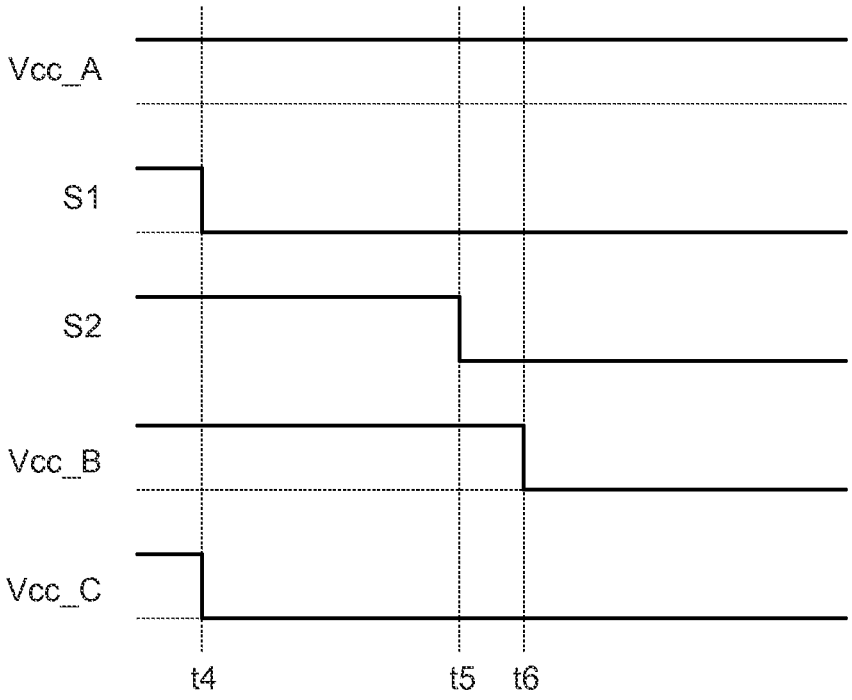

The operation of the power supply apparatus 400 when the main power switch 102 is turned off will be described below with use of FIG. 5B. Note that the waveforms and timings of the signals and voltages are exaggerated in some parts and simplified in others for the sake of convenience in the explanation.

At the time instant t4, when the main power switch 102 is switched off, the main power switch detection signal S1 falls to the low level. This is because the supply of the voltage Acc_A is terminated. When the power supply switch 121 switches off in an interlocking manner with the switching off of the main power switch 102, the supply of alternating current from the second AC supply line 111 to the third DC power source 104 is cut off. In conjunction with the switching off of the main power switch 102, the voltage Vcc_C switches instantaneously to zero. The voltage Vcc_C is the voltage for driving the motor 114 and the like. Additionally, the electric power consumption of these loads is relatively high. Consequently, when the operator switches off the main power switch 102, the supply of electric power to these loads is instantaneously terminated. Note that at this point in time, the third DC power source 104 is cut off from the second AC supply line 111, but has not been cut off from the first AC supply line 110.

During the period of time between the time instant t4 and the time instant t5, the voltage Vcc_A continues to be supplied by the first DC power source 101 to the second relay 105. For that reason, the control circuit 109 maintains the shutdown signal S2 at the high level. In other words, alternating current is being supplied to the second DC power source 103 by the AC supply line 110. Accordingly, the second DC power source 103 can put out the voltage Vcc_B even if the main power switch 102 is switched off. At the same time, the control circuit 109 can continue to run since the voltage Vcc_A continues to be supplied. However, the control circuit 109 continues to run only when the shutdown signal S2 is at the high level, and when the control circuit 109 changes the shutdown signal S2 to the low level, the control circuit 109 begins the shutdown operation. When this shutdown operation is complete, at the time instant t5, the control circuit 109 switches the shutdown signal S2 from the high level to the low level. Consequently, the second relay 105 is turned off, and the supply of power from the first AC supply line 110 is cut off. At this time, the third AC supply line 112 is still in an energized state. Consequently, at the time instant t6, the second DC power source 103 terminates the supply of the voltage Vcc_B. Additionally, with this operation, the third DC power source 104 is cut off from both the first AC supply line 110 and the second AC supply line 111.

In this way, according to the present embodiment, when the main power switch 102 switches off, the supply of electric power to loads that require shutdown is terminated after shutdown is complete, and the supply of electric power to loads that do not require shutdown can be cut off instantaneously. Furthermore, in the present embodiment, the power supply switch 121 is caused to function as a first cutoff unit. This is because the power supply switch 121 is a switch that switches on and off in an interlocking manner with the main power switch 102 switching on and off. Consequently, the number of switches and relays that are used in the prior art has been reduced in Embodiment 2 as well. Furthermore, cost can be further reduced by replacing the first relay 107 from Embodiment 1 with the power supply switch 121. This is because mechanical switches are less expensive than relays. Other advantages are as described in Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-125144, filed May 31, 2012 which is hereby incorporated by reference herein in its entirety.

What is claimed is:

1. A power supply apparatus comprising:

a power switch directly connected to a direct current line, configured to be operated manually in order to perform power source shutdown, and generate an indication signal that indicates shutdown;

a first conversion unit configured to convert alternating current supplied by an alternating-current source into direct current, and output the direct current independently of whether the power switch is in on or off;

a second conversion unit configured to convert alternating current supplied by the alternating-current source into direct current to be supplied to a second load, without using the first conversion unit;

a third conversion unit configured to convert alternating current supplied by the alternating-current source into direct current to be supplied to a first load, without using the first conversion unit;

a first cutoff unit configured to terminate an operation of the first load by cutting off a supply of alternating current from the alternating-current source to the third conversion unit when the indication signal is input;

a control unit configured to run upon being supplied with a direct current voltage output by the first conversion unit, execute shutdown processing for safely terminating an operation of the second load when the indication signal is input, and output a termination signal for terminating the operation of the second conversion unit when shutdown processing with respect to the second load is complete; and a second cutoff unit configured to terminate the second load by cutting off a supply of alternating current from the alternating-current source to the second conversion unit when the termination signal is input, wherein the first cutoff unit is further configured to cut off the supply of alternating current from the alternating-current source to the third conversion unit when one of the indication signal and the termination signal is input.

2. The power supply apparatus according to claim 1, wherein the first cutoff unit is a first relay including a first magnet coil, and when the indication signal is input to one end of the first magnet coil, the first relay is configured to operate so as to cut off the supply of alternating current from the alternating-current source to the third conversion unit.

3. The power supply apparatus according to claim 2, wherein the indication signal is a signal that sets one end of the first magnet coil to a low level.

4. The power supply apparatus according to claim 2, wherein a first switching element is connected to another end of the first magnet coil, and when the first switching element is switched off according to the termination signal, the first relay is configured to cut off the supply of alternating current from the alternating-current source to the third conversion unit.

5. The power supply apparatus according to claim 1, wherein the second cutoff unit is a second relay including a second magnet coil, a direct current voltage from the first conversion unit is applied to one end of the second magnet coil, a second switching element is connected to another end of the second magnet coil, and the second relay is configured to cut off the supply of alternating current from the alternating-current source to the second conversion unit when the second switching element is switched off according to the termination signal.

6. The power supply apparatus according to claim 1, wherein the direct current outputted from the first conversion unit is lower than the direct current outputted from the second conversion unit.

7. A power supply apparatus comprising:

a first conversion unit configured to convert alternating current supplied by an alternating-current source into direct current;

a second conversion unit configured to convert alternating current supplied by the alternating-current source into direct current to be supplied to a second load;

a third conversion unit configured to convert alternating current supplied by the alternating-current source into direct current to be supplied to a first load;

a power switch configured to be operated manually in order to perform power source shutdown, and generate an indication signal that indicates shutdown;

a first cutoff unit configured to terminate an operation of the first load by cutting off a supply of alternating current from the alternating-current source to the third conversion unit when the indication signal is input;

a control unit configured to run upon being supplied with a direct current voltage output by the first conversion unit, execute shutdown processing for safely terminating an operation of the second load when the indication signal is input, and output a termination signal for terminating the operation of the second conversion unit when shutdown processing with respect to the second load is complete; and a second cutoff unit configured to terminate the second load by cutting off a supply of alternating current from the alternating-current source to the second conversion unit when the termination signal is input, wherein the first cutoff unit is further configured to cut off the supply of alternating current from the alternating-current source to the third conversion unit when one of the indication signal and the termination signal is input, wherein the second cutoff unit is a second relay including a second magnet coil, a direct current voltage from the first conversion unit is applied to one end of the second magnet coil, a second switching element is connected to another end of the second magnet coil, and the second relay is configured to cut off the supply of alternating current from the alternating-current source to the second conversion unit when the second switching element is switched off according to the termination signal, wherein one of two lines that supply alternating current to the second conversion unit and one of two lines that supply alternating current to the third conversion unit are both connected to the second relay, and are both cut off from the alternating-current source due to the second relay switching off.

8. A power supply apparatus comprising:

a power switch directly connected to a direct current line, configured to be operated manually in order to perform power source shutdown, and generate an indication signal that indicates shutdown when switched off;

a first conversion unit configured to convert alternating current supplied by an alternating-current source to direct current and output the direct current independently of whether the power switch is in on or off;

a second conversion unit configured to convert alternating current supplied by the alternating-current source into direct current to be supplied to a second load, without using the first conversion unit;

a third conversion unit configured to convert alternating current supplied by the alternating-current source into direct current to be supplied to a first load, without using the first conversion unit;

a first cutoff unit configured to mechanically interlock with the manual operation of the power supply switch, and terminate an operation of the first load by cutting off the supply of alternating current from the alternating-current source to the third conversion unit when the power supply switch is switched off;

a control unit configured to run upon being supplied with a direct current voltage output by the first conversion unit, execute shutdown processing for terminating an operation of the second load when the indication signal is input, and output a termination signal for terminating the second conversion unit when shutdown processing with respect to the second load is complete; and a second cutoff unit configured to terminate the operation of the second load by cutting off the supply of alternating current from the alternating-current source to the second conversion unit when the termination signal is input.

9. The power supply apparatus according to claim 8, wherein the second cutoff unit is a relay including a magnet coil, a direct current voltage from the first conversion unit is applied to one end of the magnet coil, a switching element is connected to another end of the magnet coil, and the relay is configured to cut off the supply of alternating current from the alternating-current source to the second conversion unit when the switching element is switched off according to the termination signal.

10. The power supply apparatus according to claim 8, wherein the direct current outputted from the first conversion unit is lower than the direct current outputted from the second conversion unit.

11. A power supply apparatus comprising:

a first conversion unit configured to convert alternating current supplied by an alternating-current source to direct current;

a second conversion unit configured to convert alternating current supplied by the alternating-current source into direct current to be supplied to a second load;

a third conversion unit configured to convert alternating current supplied by the alternating-current source into direct current to be supplied to a first load;

a power switch configured to be operated manually in order to perform power source shutdown, and generate an indication signal that indicates shutdown when switched off;

a first cutoff unit configured to mechanically interlock with the manual operation of the power supply switch, and terminate an operation of the first load by cutting off the supply of alternating current from the alternating-current source to the third conversion unit when the power supply switch is switched off;

a control unit configured to run upon being supplied with a direct current voltage output by the first conversion unit, execute shutdown processing for terminating an operation of the second load when the indication signal is input, and output a termination signal for terminating the second conversion unit when shutdown processing with respect to the second load is complete; and a second cutoff unit configured to terminate the operation of the second load by cutting off the supply of alternating current from the alternating-current source to the second conversion unit when the termination signal is input;

wherein the second cutoff unit is a relay including a magnet coil, a direct current voltage from the first conversion unit is applied to one end of the magnet coil, a switching element is connected to another end of the magnet coil, and the relay is configured to cut off the supply of alternating current from the alternating-current source to the second conversion unit when the switching element is switched off according to the termination signal, and wherein one of two lines that supply alternating current to the second conversion unit and one of two lines that supply alternating current to the third conversion unit are both connected to the relay, and are both cut off from the alternating-current source due to the relay switching off.

12. An image forming apparatus comprising:

a power switch directly connected to a direct current line, configured to be operated manually in order to shut down the image forming apparatus and generate an indication signal that indicates shutdown;

an image forming unit configured to form an image on a sheet, the image forming unit having a first load that is driven in order to perform image formation;

a first conversion unit configured to convert alternating current supplied by an alternating-current source into direct current and output the direct current independently of whether the power switch is in on or off;

a second conversion unit configured to convert alternating current supplied by the alternating-current source into direct current to be supplied to a second load, without using the first conversion unit;

a third conversion unit configured to convert alternating current supplied by the alternating-current source into direct current to be supplied to a first load, without using the first conversion unit;

a first cutoff unit configured to terminate an operation of the first load by cutting off a supply of alternating current from the alternating-current source to the third conversion unit when the indication signal is input;

a control unit configured to run upon being supplied with a direct current voltage output by the first conversion unit, execute shutdown processing for safely terminating an operation of the second load when the indication signal is input, and output a termination signal for terminating the second conversion unit when shutdown processing with respect to the second load is complete; and a second cutoff unit configured to terminate the operation of the second load by cutting off a supply of alternating current from the alternating-current source to the second conversion unit when the termination signal is input, wherein the first cutoff unit is further configured to cut off the supply of alternating current from the alternating-current source to the third conversion unit when one of the indication signal and the termination signal is input.

13. The image forming apparatus according to claim 12, wherein the first cutoff unit is a first relay including a first magnet coil, and when the indication signal is input to one end of the first magnet coil, the first relay is configured to operate so as to cut off the supply of alternating current from the alternating-current source to the third conversion unit.

14. The image forming apparatus according to claim 13, wherein the indication signal is a signal that sets one end of the first magnet coil to a low level.

15. The image forming apparatus according to claim 13, wherein a first switching element is connected to another end of the first magnet coil, and when the first switching element is switched off according to the termination signal, the first relay is configured to cut off the supply of alternating current from the alternating current source to the third conversion unit.

16. The image forming apparatus according to claim 12, wherein the second cutoff unit is a second relay including a second magnet coil, a direct current voltage from the first conversion unit is applied to one end of the second magnet coil, a second switching element is connected to another end of the second magnet coil, and the second relay is configured to cut off the supply of alternating current from the alternating-current source to the second conversion unit when the second switching element is switched off according to the termination signal.

17. The image forming apparatus according to claim 12, wherein the direct current outputted from the first conversion unit is lower than the direct current outputted from the second conversion unit.

18. A power supply apparatus comprising:

an image forming unit configured to form an image on a sheet, the image forming unit having a first load that is driven in order to perform image formation;

a first conversion unit configured to convert alternating current supplied by an alternating-current source into direct current;

a second conversion unit configured to convert alternating current supplied by the alternating-current source into direct current to be supplied to a second load;

a third conversion unit configured to convert alternating current supplied by the alternating-current source into direct current to be supplied to a first load;

a power switch configured to be operated manually in order to shut down the image forming apparatus and generate an indication signal that indicates shutdown;

a first cutoff unit configured to terminate an operation of the first load by cutting off a supply of alternating current from the alternating-current source to the third conversion unit when the indication signal is input;

a control unit configured to run upon being supplied with a direct current voltage output by the first conversion unit, execute shutdown processing for safely terminating an operation of the second load when the indication signal is input, and output a termination signal for terminating the second conversion unit when shutdown processing with respect to the second load is complete; and a second cutoff unit configured to terminate the operation of the second load by cutting off a supply of alternating current from the alternating-current source to the second conversion unit when the termination signal is input, wherein the first cutoff unit is further configured to cut off the supply of alternating current from the alternating-current source to the third conversion unit when one of the indication signal and the termination signal is input;

wherein the second cutoff unit is a second relay including a second magnet coil, a direct current voltage from the first conversion unit is applied to one end of the second magnet coil, a second switching element is connected to another end of the second magnet coil, and the second relay is configured to cut off the supply of alternating current from the alternating-current source to the second conversion unit when the second switching element is switched off according to the termination signal; and wherein one of two lines that supply alternating current to the second conversion unit and one of two lines that supply alternating current to the third conversion unit are both connected to the second relay, and are both cut off from the alternating-current source due to the second relay switching off.

19. An image forming apparatus comprising:

a power switch directly connected to a direct current line, configured to be operated manually in order to perform power source shutdown, and generate an indication signal that indicates shutdown when switched off;

an image forming unit configured to form an image on a sheet, the image forming unit having a first load that is driven in order to perform image formation;

a first conversion unit configured to convert alternating current supplied by an alternating-current source into direct current, and output the direct current independently of whether the power switch is in on or off;

a second conversion unit configured to convert alternating current supplied by the alternating-current source into direct current to be supplied to a second load, without using the first conversion unit;

a third conversion unit configured to convert alternating current supplied by the alternating-current source into direct current to be supplied to a first load, without using the first conversion unit;

a first cutoff unit configured to mechanically interlock with the manual operation of the power supply switch, and terminates an operation of the first load by cutting off the supply of alternating current from the alternating-current source to the third conversion unit when the power supply switch is switched off;

a control unit configured to run upon being supplied with a direct current voltage output by the first conversion unit, execute shutdown processing for terminating an operation of the second load when the indication signal is input, and output a termination signal for terminating the second conversion unit when shutdown processing with respect to the second load is complete; and a second cutoff unit configured to terminate the operation of the second load by cutting off the supply of alternating current from the alternating-current source to the second conversion unit when the termination signal is input.

20. The image forming apparatus according to claim 19, wherein the second cutoff unit is a relay including a magnet coil, a direct current voltage from the first conversion unit is applied to one end of the magnet coil, a switching element is connected to another end of the magnet coil, and the relay is configured to cut off the supply of alternating current from the alternating-current source to the second conversion unit when the switching element is switched off according to the termination signal.

21. The image forming apparatus according to claim 19, wherein the direct current outputted from the first conversion unit is lower than the direct current outputted from the second conversion unit.

22. A power supply apparatus comprising:

an image forming unit configured to form an image on a sheet, the image forming unit having a first load that is driven in order to perform image formation;

a first conversion unit configured to convert alternating current supplied by an alternating-current source into direct current;

a second conversion unit configured to convert alternating current supplied by the alternating-current source into direct current to be supplied to a second load;

a third conversion unit configured to convert alternating current supplied by the alternating-current source into direct current to be supplied to a first load;

a power switch configured to be operated manually in order to perform power source shutdown, and generate an indication signal that indicates shutdown when switched off;

a first cutoff unit configured to mechanically interlock with the manual operation of the power supply switch, and terminates an operation of the first load by cutting off the supply of alternating current from the alternating-current source to the third conversion unit when the power supply switch is switched off;

a control unit configured to run upon being supplied with a direct current voltage output by the first conversion unit, execute shutdown processing for terminating an operation of the second load when the indication signal is input, and output a termination signal for terminating the second conversion unit when shutdown processing with respect to the second load is complete; and a second cutoff unit configured to terminate the operation of the second load by cutting off the supply of alternating current from the alternating-current source to the second conversion unit when the termination signal is input;

wherein the second cutoff unit is a relay including a magnet coil, a direct current voltage from the first conversion unit is applied to one end of the magnet coil, a switching element is connected to another end of the magnet coil, and the relay is configured to cut off the supply of alternating current from the alternating-current source to the second conversion unit when the switching element is switched off according to the termination signal; and wherein one of two lines that supply alternating current to the second conversion unit and one of two lines that supply alternating current to the third conversion unit are both connected to the relay, and are both cut off from the alternating-current source due to the relay switching off.

* * * * *